US009880481B2

(12) United States Patent
Momotani et al.

(10) Patent No.: US 9,880,481 B2
(45) Date of Patent: Jan. 30, 2018

(54) LIQUID DEVELOPER SET

(71) Applicant: Konica Minolta, Inc., Chiyoda-ku (JP)

(72) Inventors: Keiko Momotani, Ibaraki (JP); Naoki Yoshie, Ibaraki (JP); Yukiko Uno, Kyoto (JP); Masaaki Oka, Kyoto (JP)

(73) Assignee: KONICA MINOLTA, INC., Chiyoda-Ku, Tokyo (JP)

( * ) Notice: Subject to any disclaimer, the term of this patent is extended or adjusted under 35 U.S.C. 154(b) by 43 days.

(21) Appl. No.: 14/492,128

(22) Filed: Sep. 22, 2014

(65) Prior Publication Data

US 2015/0093700 A1 Apr. 2, 2015

(30) Foreign Application Priority Data

Sep. 27, 2013 (JP) ..... 2013-201743

(51) Int. Cl.

| | |
|---|---|
| ***G03G 9/13*** | (2006.01) |
| ***G03G 9/093*** | (2006.01) |
| ***G03G 9/12*** | (2006.01) |

(52) U.S. Cl.

CPC ..... *G03G 9/131* (2013.01); *G03G 9/09321* (2013.01); *G03G 9/09364* (2013.01); *G03G 9/09392* (2013.01); *G03G 9/122* (2013.01); *G03G 9/13* (2013.01)

(58) Field of Classification Search

CPC ..... G03G 9/131; G03G 9/13; G03G 9/09321; G03G 9/122; G03G 9/12; G03G 9/09364

USPC ..... 430/114, 112, 45.2

See application file for complete search history.

(56) References Cited

U.S. PATENT DOCUMENTS

| | | | | |
|---|---|---|---|---|
| 5,765,084 A * | 6/1998 | Asada | ..... | G03G 15/161 399/233 |
| 2014/0234769 A1* | 8/2014 | Yoshie | ..... | G03G 9/12 430/112 |

FOREIGN PATENT DOCUMENTS

| | | | |
|---|---|---|---|
| JP | 10-254185 | A | 9/1998 |
| JP | 2002356635 | A | 12/2002 |
| JP | 2003248344 | A | 9/2003 |
| JP | 2004037954 | A | 2/2004 |
| JP | 2004051802 | A | 2/2004 |
| JP | 2004086158 | A | 3/2004 |
| JP | 2009-96994 | A | 5/2009 |

OTHER PUBLICATIONS

Japanese Patent Office J-PlatPat machine-assisted English-language translation of Japanese Patent 2004-037954 (pub Feb. 2004).*

Japanese Office Action dated Jan. 31, 2017 issued in corresponding Japanese Patent Appln. No. 2013-201743, with English translation (7 pages).

* cited by examiner

*Primary Examiner* — Janis L Dote

(74) *Attorney, Agent, or Firm* — Buchanan Ingersoll & Rooney PC

(57) ABSTRACT

A liquid developer set of the present invention includes a first liquid developer including an insulating liquid and first toner particles and a second liquid developer including an insulating liquid and second toner particles, the first toner particles include carbon black and a first resin, the second toner particles include a coloring agent other than carbon black and a second resin, without including carbon black, the first resin and the second resin each include a hydrocarbon long chain which is a hydrocarbon group having a carbon number of 8 to 30, and a mass ratio of the hydrocarbon long chain to the first toner particles is higher than a mass ratio of the hydrocarbon long chain to the second toner particles.

15 Claims, 1 Drawing Sheet

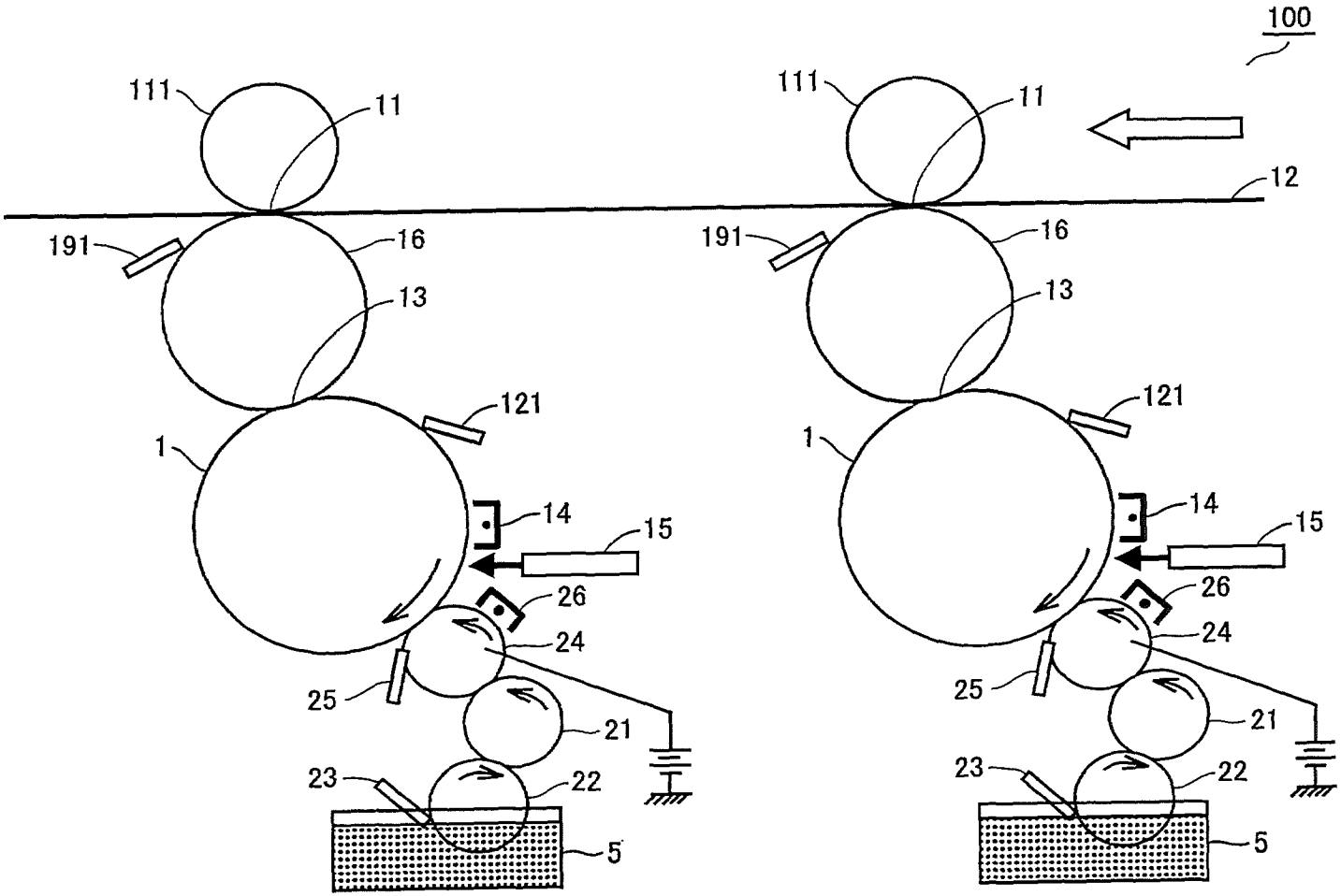
100
12
111
11
16
13
121
14
15
26
24
21
22
5
25
23
1
191
111
11
16
13
121
14
15
26
24
21
22
5'
25
23
1
191

LIQUID DEVELOPER SET

This application is based on Japanese Patent Application No. 2013-201743 filed with the Japan Patent Office on Sep. 27, 2013, the entire content of which is hereby incorporated by reference.

BACKGROUND OF THE INVENTION

Field of the Invention

The present invention relates to a liquid developer set.

Description of the Related Art

In a liquid developer (also called wet developer), toner particles can have a small particle size of 2 μm or less as compared with a dry developer. Therefore, the amount of toner particles of the liquid developer attached onto a recording medium can considerably be reduced as compared with the dry developer. In order to still achieve a desired image density with the small amount of attached toner particles, however, the liquid developer has a content of a coloring agent in the toner particles higher than a content of a coloring agent in toner particles of the dry developer.

In the case where the liquid developer is black in color, the content of a coloring agent in the black liquid developer has to be made higher as compared with the contents of coloring agents in liquid developers of other colors, in order to obtain a high-density black image and thereby meet the need of a higher image quality. Accordingly, the content of a coloring agent in toner particles of the black liquid developer tends to be higher. As such a coloring agent for black color, carbon black is commonly used.

Toner particles included in such a liquid developer are produced by means of a granulation method according to which a monomer is granulated while being polymerized by any of a variety of methods, or by means of a pulverization method according to which a polymer is prepared and thereafter pulverized into fine particles. Of these methods, the granulation method using a resin of the core-shell structure for example is known (Japanese Laid-Open Patent Publication No. 2009-096994).

SUMMARY OF THE INVENTION

In the case where a resin included in toner particles of a liquid developer has the core-shell structure and the toner particles are obtained by means of the granulation method, a higher content of a coloring agent tends to cause the shape of the toner particles after granulation to be distorted due to the filler effect of the coloring agent. The reason for this is assumed to be the fact that the coloring agent may hinder the ease of granulation of the toner particles or that pulverization originates in the coloring agent when pulverization is done. The inventors of the present invention have conducted studies to find that distortion of the shape of the toner particles tends to increase the viscosity of the liquid developer.

In other words, on the condition that the type of an insulating liquid (also called carrier liquid) in which toner particles are dispersed and the content of the toner particles are the same, the viscosity of the liquid developer is closely related to the particle size distribution of the toner particles and the shape of the toner particles. In particular, the shape of the toner particles has a significant influence on the viscosity of the liquid developer. As the shape of the toner particles is distorted, the viscosity of the liquid developer is increased.

As described above, the liquid developer for black color has a higher content of a coloring agent than liquid developers of other colors. Therefore, due to the filler effect of the coloring agent, the shape of the toner particles is likely to distort, and accordingly the viscosity of the liquid developer for black color is higher than the viscosity of the liquid developers of other colors. Thus, in the case where a set of the liquid developer for black color and liquid developers for other colors is used in an image forming apparatus, the following problem arises. Namely, these liquid developers are different in viscosity from each other, which results in differences in what state a thin layer is formed on the surfaces of a variety of rollers such as photoconductor by each liquid developer or differences in what state each liquid developer is transported. Accordingly, a desired image may not be obtained in some cases.

Regarding the case where toner particles of a liquid developer are obtained by means of the pulverization method, it has also been found that an increased content of a coloring agent causes the filler effect thereof, which distorts the shape of the toner particles having been pulverized into fine particles, similarly to the case where the toner particles are obtained by means of the granulation method. Thus, in the case where toner particles are produced by means of the pulverization method as well, a problem arises of an increase of the viscosity of a liquid developer for black color in which the content of a coloring agent is high.

The present invention has been made in view of the above-described problems, and an object of the present invention is to provide a liquid developer set that causes no inconvenience even when a set of a plurality of liquid developers is used in an image forming apparatus, by reducing a difference in viscosity between a liquid developer for black color and liquid developers for other colors.

Specifically, a liquid developer set of the present invention includes a first liquid developer including an insulating liquid and first toner particles and a second liquid developer including an insulating liquid and second toner particles, the first toner particles including carbon black and a first resin, the second toner particles including a coloring agent other than carbon black and a second resin, without including carbon black, the first resin and the second resin each including a hydrocarbon long chain which is a hydrocarbon group having a carbon number of 8 to 30, and a mass ratio of the hydrocarbon long chain to the first toner particles being higher than a mass ratio of the hydrocarbon long chain to the second toner particles.

Preferably, the first resin and the second resin each include a vinyl resin, and the hydrocarbon long chain is present in a side chain of the vinyl resin.

Preferably, the first resin has a core-shell structure made up of a first core resin and a first shell resin, the first core resin includes the carbon black, the first shell resin includes the hydrocarbon long chain, a ratio C1:S1 falls within a range of 99:1 to 30:70 where C1 is a mass of the first core resin and S1 is a mass of the first shell resin, the second resin has a core-shell structure made up of a second core resin and a second shell resin, the second core resin includes the coloring agent other than carbon black, the second shell resin includes the hydrocarbon long chain, and a ratio C2:S2 falls within a range of 99:1 to 30:70 where C2 is a mass of the second core resin and S2 is a mass of the second shell resin.

Preferably, a mass ratio of the hydrocarbon long chain to the first shell resin is higher than a mass ratio of the hydrocarbon long chain to the second shell resin. Preferably, the liquid developer set includes one kind or two or more kinds of the second liquid developers.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 1 is a schematic conceptual diagram of an image forming apparatus.

DESCRIPTION OF THE PREFERRED EMBODIMENTS

In the following, embodiments of the present invention will be described in more detail.

<Liquid Developer Set>

A liquid developer set in the present embodiment includes a first liquid developer including an insulating liquid and first toner particles and a second liquid developer including an insulating liquid and second toner particles, the first toner particles including carbon black and a first resin, the second toner particles including a coloring agent other than carbon black and a second resin, without including carbon black, the first resin and the second resin each including a hydrocarbon long chain which is a hydrocarbon group having a carbon number of 8 to 30, and a mass ratio of the hydrocarbon long chain to the first toner particles being higher than a mass ratio of the hydrocarbon long chain to the second toner particles.

Here, the hydrocarbon long chain is a hydrocarbon group having a carbon number of 8 to 30. The hydrocarbon group may be in the form of a straight chain (octyl group for example), or in the form of a branch (also called ramification, branch and ramification are both expressed herein as "branch" depending on the case) (isooctyl group for example), or partially or wholly cyclized. As long as the hydrocarbon group is made up of carbon and hydrogen with a principal chain of a carbon-to-carbon bond, hydrogen may partially be replaced with another substituent (halogen for example). As long as the hydrocarbon group has this structure, it can have a valence of one (alkyl group for example) or a valence of two or more (alkylene group for example) (in the case where the hydrocarbon group includes an element other than carbon and hydrogen, it is supposed that the mass of the other element is not included). The hydrocarbon group also includes a hydrocarbon group bonded to an element other than carbon and hydrogen to form a part of a group which is called by another name under the chemical nomenclature (alkoxy group for example). The hydrocarbon group may include a double bond as a part of carbon-to-carbon bonds (oleyl group for example).

An example of this hydrocarbon long chain can for example be a straight chain alkyl group or a branched alkyl group expressed by a general formula "$C_nH_{2n+1}$" (n is an integer of 8 or more and 30 or less).

This hydrocarbon long chain has a strong affinity for the insulating liquid which is a component of the liquid developer. Thus, in the first resin which is a component of the first toner particles containing a high concentration of carbon black and distorted in shape due to the filler effect of the carbon black, a higher content of the hydrocarbon long chain enhances the affinity between the first toner particles and the insulating liquid to thereby prevent the viscosity of the first liquid developer from increasing.

Specifically, the mass ratio of the hydrocarbon long chain to the first toner particles is made higher than the mass ratio of the hydrocarbon long chain to the second toner particles to thereby prevent increase of the viscosity of the first liquid developer which includes the first toner particles having a high degree of distortion, and successfully reduce a difference in viscosity between the first liquid developer and the second liquid developer. In order to reduce the viscosity of the liquid developer, usually a toner dispersant may be added. Addition of a large amount of the toner dispersant, however, reduces electrical insulation of the liquid developer itself, which causes a problem that the efficiency of electrostatic movement of the toner particles such as development or transfer during formation of an image is decreased, or a problem that the resultant image is nonuniform. The liquid developer in the present embodiment also drastically solves these problems.

As long as the mass ratio of the hydrocarbon long chain to the first toner particles is made higher than the mass ratio of the hydrocarbon long chain to the second toner particles, the range of each mass ratio is not particularly limited. Usually, this mass ratio can fall within a range of 0.5% or more and 30% or less, and more preferably a range of 2% or more and 10% or less. The mass ratio of the hydrocarbon long chain to the first toner particles is suitably 1.02 to 5 times, and more preferably 1.1 to 2 times as high as the mass ratio of the hydrocarbon long chain to the second toner particles. This is for the following reason. If the difference in the mass ratio of the hydrocarbon long chain between the first toner particles and the second toner particles is too small, the effect of reducing the difference in the viscosity in the present application is accordingly small. If the difference in the mass ratio therebetween is too large, the relation in the magnitude of the viscosity may be reversed (the viscosity of the first liquid developer may be lower than the viscosity of the second liquid developer).

The mass ratio of the hydrocarbon long chain to the toner particles is herein determined by dividing the total mass of the hydrocarbon long chain by the total mass of the toner particles. This mass ratio can be set by adjusting the mass ratio of raw materials when each of the first and second toner particles are manufactured. After the liquid developer has been prepared, the mass ratio can be determined in the following way. A GC/MS apparatus (trademark: "GCMS-QP2010" manufactured by Shimadzu Corporation) to which connected a pyrolysis-gas chromatography/mass spectrometer (P-GC/MS) (trademark: "PY-2020iD" manufactured by Frontier Laboratories Ltd.) is used to determine the total mass of the first toner particles and the total mass of the hydrocarbon long chain included in the first toner particles, as well as the total mass of the second toner particles and the total mass of the hydrocarbon long chain included in the second toner particles, and the latter mass is divided by the former mass for each of the first and second toner particles.

The comparison between the first toner particles and the second toner particles in terms of this mass ratio is preferably made between the first toner particles and the second toner particles manufactured by means of the same kind of manufacture method. Namely, in the case where the first toner particles (first liquid developer) are manufactured by means of the granulation method, preferably the comparison in the mass ratio is made between the first toner particles and the second toner particles (second liquid developer) manufactured by means of the granulation method. In the case where the first toner particles (first liquid developer) is manufactured by means of the pulverization method, preferably the comparison in the mass ratio is made between the first toner particles and the second toner particles (second liquid developer) manufactured by means of the pulverization method. This is because the toner particles are likely to vary in shape depending on the manufacture method, and also distort in different degrees. In view of this, it is more preferable to make the comparison between the first toner particles and the second toner particles included in a liquid developer set that are both manufactured by means of the granulation method so that they have a core-shell structure.

This hydrocarbon long chain has the function as described above and is therefore preferably present in a side chain of a vinyl resin, so that fulfillment of the function is facilitated. Namely, preferably the aforementioned first resin and second resin each include a vinyl resin, and the hydrocarbon long chain is present in a side chain of the vinyl resin. The side chain of the vinyl resin herein refers to a portion branched from the principal chain of carbon-to-carbon bonds coupled by polymerization of a vinyl group (namely the portion which is not included in the principal chain). In the case for example where the vinyl resin is an acrylic resin, the side chain refers to an ester group portion of an acrylic ester which is a constituent unit of the acrylic resin. The vinyl resin refers to a resin (polymer) such as acrylic resin obtained by polymerization of a monomer having a polymerizable double bond (vinyl group ($CH_2$═CH—) or vinylidene group ($CH_2$═C═)).

The liquid developer set includes the first liquid developer and the second liquid developer which are distinguished from each other in terms of whether or not the toner particles include carbon black, and used by being placed in one image forming apparatus. Preferably these first liquid developer and second liquid developer are held in separate holding means (cartridges for example) until used in a process of forming an image in the image forming apparatus.

This image forming apparatus can for example be an electrophotographic image forming apparatus such as copier, printer, digital printing machine, or simple printing machine. The liquid developer set is used in such an image forming apparatus as a liquid developer for an electrophotograph, a paint, a liquid developer for electrostatic recording, an oil-based ink for an inkjet printer, an ink for electronic paper, or the like.

This liquid developer set can include one kind or two or more kinds of the second liquid developers. In the case where a color image is to be formed in the aforementioned image forming apparatus, a plurality of liquid developers of black, cyan, magenta, yellow and the like are used. Among these liquid developers, the first liquid developer in the present embodiment includes carbon black as a coloring agent, and is therefore usually a liquid developer for black color. In contrast, the second liquid developer does not include carbon black but includes a coloring agent other than carbon black, and is therefore usually a liquid developer(s) for one or more colors that are cyan, magenta, and yellow. Namely, the liquid developer set in the present embodiment may include two or more kinds of the second liquid developers. In this case, these second liquid developers include respective coloring agents different from each other.

As long as the liquid developer set in the present embodiment includes the first liquid developer and one or more second liquid developers as described above, use of a third liquid developer (a liquid developer including toner particles having the mass ratio of the hydrocarbon long chain still higher than the mass ratio of the hydrocarbon long chain to the first toner particles) together with the first and second liquid developers is not excluded.

<Liquid Developer>

The first liquid developer included in the liquid developer set in the present embodiment includes an insulating liquid and the first toner particles, and the second liquid developer includes an insulating liquid and the second toner particles.

Regarding the content by percentage of the toner particles included in each liquid developer, there is no particular difference between the first liquid developer and the second liquid developer. In terms of the fixity of the toner particles and the heat-resistance stability of the liquid developer, the content of the toner particles is preferably 10 to 50 mass %, more preferably 15 to 45 mass %, and still more preferably 20 to 40 mass %.

Each liquid developer in the present embodiment can be the one in which toner particles are self-dispersed without use of a toner dispersant as another component other than the above-described two requisite components.

<Toner Particles>

In the present embodiment, the first toner particles include carbon black and the first resin, and the second toner particles include a coloring agent other than carbon black and the second resin, without including carbon black. As long as each of the first toner particles and the second toner particles include the aforementioned components, it can include any other components. The other components can include for example pigment dispersant, wax, charge control agent, filler, antistatic agent, mold release agent, ultraviolet absorber, antioxidant, anti-blocking agent, heat-resistance stabilizer, flame retardant, and the like.

Preferably, the first toner particles and the second toner particles each have an average particle size of 0.5 μm or more and 5.0 μm or less. The average particle size represents a median size ($D_{50}$) of the volume distribution and can be determined with any of a variety of particle size distribution meters.

The aforementioned average particle size is smaller than the particle size of toner particles in the conventionally used dry developer (powder developer), and is one of the characteristics of the present embodiment. The average particle size which is smaller than 0.5 μm reduces mobility in an electric field due to the excessively small particle size, which may result in deterioration of the quality of development. The average particle size which is larger than 5.0 μm reduces uniformity, which may result in deterioration of the image quality. The average particle size is more preferably 0.5 μm or more and 3.0 μm or less.

The content of carbon black in the first toner particles is preferably 5 mass % or more and 40 mass % or less, and more preferably 10 mass % or more and 30 mass % or less. If the content is less than 5 mass %, it may be difficult to obtain, from a small amount of attached toner particles, a print-like image having good color development. If the content is more than 40 mass %, the electrical insulation of the toner particles is lower due to the high electrical conductivity of carbon black, which may result in reduction of the transfer efficiency or reduction of the image quality.

The total content of the coloring agents in each of the first toner particles and the second toner particles is preferably 5 mass % or more and 50 mass % or less, and more preferably 10 mass % or more and 40 mass % or less. If the total content is less than 5 mass %, it may be difficult to obtain, from a small amount of attached toner particles, a print-like image having good color development. If the total content is more than 50 mass %, the ratio of the resin is accordingly lower, which may result in an insufficient fixing strength.

<Resin>

The first resin and the second resin in the present embodiment each include a hydrocarbon long chain which is a hydrocarbon group having a carbon number of 8 to 30. As long as the mass ratio of the hydrocarbon long chain satisfies the above-described relationship, conventionally known resins can be used without particular limitation. As long as the mass ratio of the hydrocarbon long chain satisfies the above-described relationship, the first resin and the second resin may be resins of the same kind in terms of the chemical structure, or may be resins of different kinds. In terms of adjustment of the viscosity of the liquid developer by means of the function of the hydrocarbon long chain, however, use of resins of the same kind which are easier to control is preferred.

Preferably, the first resin and the second resin each include a vinyl resin, and the hydrocarbon long chain is present in a side chain of the vinyl resin. This is for the reasons that the content of the hydrocarbon long chain can be controlled relatively easily, and the hydrocarbon long chain which is present in the surface of toner particles easily interact with the insulating liquid.

Preferably, the first resin in the present embodiment has a core-shell structure made up of a first core resin and a first shell resin, the first core resin includes the carbon black, the first shell resin includes the hydrocarbon long chain, a ratio C1:S1 falls within a range of 99:1 to 30:70 where C1 is a mass of the first core resin and S1 is a mass of the first shell resin, the second resin has a core-shell structure made up of a second core resin and a second shell resin, the second core resin includes the coloring agent other than carbon black, the second shell resin includes the hydrocarbon long chain, and a ratio C2:S2 falls within a range of 99:1 to 30:70 where C2 is a mass of the second core resin and S2 is a mass of the second shell resin. In this case, preferably a mass ratio of the hydrocarbon long chain to the first shell resin is higher than a mass ratio of the hydrocarbon long chain to the second shell resin.

The core-shell structure herein refers to a structure in which the surface of the core resin is partially or entirely covered with the shell resin. The ratio C1:S1 is more preferably 97:3 to 65:35, and the ratio C2:S2 is more preferably 97:3 to 65:35. If the ratio C1:S1 and the ratio C2:S2 are out of the range 99:1 to 30:70, the uniformity of the particle size may be deteriorated or the dispersion stability during storage may be deteriorated.

In the case where the resin has the core-shell structure as described above, each of the toner particles (the first toner particles and the second toner particles) itself has the core-shell structure.

Thus, the resin has the core-shell structure and the shell resin includes the hydrocarbon long chain. Accordingly, the hydrocarbon long chain is present in the surface of the toner particles and therefore easily exhibits the effect of reducing the viscosity of the liquid developer by its affinity for the insulating liquid. In this respect, it is particularly preferred that the shell resin is a vinyl resin.

The mass ratio of the hydrocarbon long chain to the first shell resin is made higher than the mass ratio of the hydrocarbon long chain to the second shell resin, which is preferred since the viscosity of the first liquid developer can effectively be reduced without reduction of the average particle size. In contrast, if the mass ratio of the hydrocarbon long chain to the first shell resin and the mass ratio of the hydrocarbon long chain to the second shell resin are made equal to each other and the amount of the first shell resin to be used is made larger than the amount of the second shell resin to be used, the average particle size of the first toner particles is smaller, which may result in insufficiency in the desired reduction of the viscosity. Therefore, it is significantly advantageous to make the mass ratio of the hydrocarbon long chain to the first shell resin higher than the mass ratio of the hydrocarbon long chain to the second shell resin.

While the mass ratio of the hydrocarbon long chain to the first shell resin is not particularly limited, it is 20 to 80%, more preferably 30 to 70%. While the mass ratio of the hydrocarbon long chain to the second shell resin is not particularly limited as well, it is 20 to 80%, more preferably 30 to 70%. If the mass ratio is less than 20% or more than 80%, the ease of granulation may be deteriorated. The mass ratio of the hydrocarbon long chain to the first shell resin is suitably 1.02 to 5 times, more preferably 1.1 to 2 times as high as the mass ratio of the hydrocarbon long chain to the second shell resin. This is for the following reason. If the difference in the mass ratio of the hydrocarbon long chain between the first shell resin and the second shell resin is too small, the effect of reducing the difference in the viscosity in the present application is accordingly small. If the difference in the mass ratio therebetween is too large, the relation in the magnitude of the viscosity may be reversed (the viscosity of the first liquid developer may be lower than the viscosity of the second liquid developer).

Specific examples of the first resin and the second resin will be further detailed herein in the section: Method of Manufacturing Toner Particles described later herein.

<Coloring Agent>

The first toner particles in the present embodiment include carbon black as a coloring agent. The first toner particles may include other coloring agents as long as the first toner particles include carbon black. An example of the other coloring agents may be the coloring agent included in the second toner particles as described below.

The second toner particles include a coloring agent other than carbon black, without including carbon black.

Such a coloring agent is present, in the toner particles, in the form of being dispersed in the resin. Namely, in the first toner particles, carbon black is present in the form of being dispersed in the first resin and, in the second toner particles, the coloring agent is present in the form of being dispersed in the second resin.

In the case where the first resin has the core-shell structure made up of the first core resin and the first shell resin, carbon black is preferably included in the first core resin. Carbon black, however, may be included in the first shell resin. In the case where the second resin has the core-shell structure made up of the second core resin and the second shell resin, the coloring agent is preferably included in the second core resin. The coloring agent, however, may be included in the second shell resin. In the case where each toner particle further includes other components, the other components may be included in each core resin or each shell resin.

Preferably, the particle size of the coloring agent in the present embodiment is 0.3 μm or less. If the particle size of the coloring agent is more than 0.3 μm, the dispersibility is deteriorated and the glossiness is also deteriorated, which may result in failure to reproduce a desired color. Coloring agents as described above are roughly classified into pigments and dyes. If a dye is used, problems arise such as transfer of the color to the insulating liquid to cause the background to be colored or low light fastness of the formed image. Therefore, use of a pigment is preferred. If a dye is included as the coloring agent, however, this does not go beyond the scope of the present invention. In the following, a pigment used as the coloring agent will be described.

First, as such a pigment, a conventionally known pigment can be used without particular limitation. In terms of cost, light fastness, colorability, and the like, however, the following pigments are preferably used for example. Based on the color structure, these pigments are usually classified into the black pigment, the yellow pigment, the magenta pigment, and the cyan pigment. Basically colors (color images) other than black are toned through subtractive mixture of colors of a yellow pigment, a magenta pigment, and a cyan pigment.

Carbon black included in the first toner particles is a generic name for black fine particles in which carbon is a main component. While carbon black is chemically classified as a sole carbon in some cases, carbon black may include a variety of functional groups as is well known and belongs to the black pigment in accordance with the above-described manner of classification. The kind of this carbon black is not particularly limited, and examples of carbon black can be thermal black, acetylene black, channel black, furnace black, lamp black, aniline black, biomass-derived carbon black, and the like.

The coloring agent other than carbon black included in the second toner particles can be a black pigment, for example, magnetic powder such as magnetite or ferrite, nigrosine which is an azine compound and a purple-black dye (C.I. solvent black 7 or C.I. solvent black 5 for example), or the like.

The coloring agent other than carbon black can also be a magenta pigment, for example, C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178, C.I. Pigment Red 222, or the like.

The coloring agent other than carbon black can also be a yellow pigment such as C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 138, C.I. Pigment Yellow 155, C.I. Pigment Yellow 180, C.I. Pigment Yellow 185, or the like.

The coloring agent other than carbon black can also be a cyan pigment such as C.I. Pigment Blue 15, C.I. Pigment Blue 15:2, C.I. Pigment Blue 15:3, C.I. Pigment Blue 15:4, C.I. Pigment Blue 16, C.I. Pigment Blue 60, C.I. Pigment Blue 62, C.I. Pigment Blue 66, C.I. Pigment Green 7, or the like.

Regarding the coloring agent included in the second toner particles, the second toner particles can include one of or a combination of two or more of the coloring agents exemplified above, as required. As set forth above, the first toner particles can also include one of or a combination of two or more of the coloring agents exemplified above, as required.

<Pigment Dispersant>

Each of the first toner particles and the second toner particles can include a pigment dispersant. The pigment dispersant has a function of uniformly dispersing the coloring agent (pigment) in each toner particle, and preferably a basic dispersant is used. The basic dispersant is herein defined as follows. Specifically, 0.5 g of a pigment dispersant and 20 ml of distilled water are placed in a screw tube made of glass, shook and mixed by means of a paint shaker for 30 minutes, and thereafter filtered. The pH of the resultant filtrate is measured with a pH meter (trademark: "D-51" manufactured by HORIBA, Ltd.). In the case the filtrate has a pH of more than 7, it is identified as a basic dispersant. In the case where the filtrate has a pH of less than 7, it is called acid dispersant.

The kind of this basic dispersant is not particularly limited. For example, it may be a compound (dispersant) having, in a molecule of the dispersant, a functional group such as amine group, amino group, amide group, pyrrolidone group, imine group, imino group, urethane group, quaternary ammonium group, ammonium group, pyridino group, pyridium group, imidazolino group, imidazolium group, and the like. The dispersant is usually a so-called interface-active agent having in its molecule a hydrophilic portion and a hydrophobic portion. A variety of compounds can be used as the pigment dispersant as long as they perform a function of dispersing the coloring agent (pigment).

Commercially available products of such a basic pigment dispersant can for example be "Ajisper PB-821" (trademark), "Ajisper PB-822" (trademark), and "Ajisper PB-881" (trademark) manufactured by Ajinomoto Fine-Techno Co., Inc., "Solsperse 28000" (trademark), "Solsperse 32000" (trademark), "Solsperse 32500" (trademark), "Solsperse 35100" (trademark), and "Solsperse 37500" (trademark) manufactured by Lubrizol Japan Limited, and the like.

It is more preferable to select a pigment dispersant that is not dissolved in an insulating liquid (carrier liquid). For this reason, "Ajisper PB-821" (trademark), "Ajisper PB-822" (trademark), and "Ajisper PB-881" (trademark) manufactured by Ajinomoto Fine-Techno Co., Inc. are more preferable.

The amount of this pigment dispersant as added is preferably 1 to 100 mass % relative to the coloring agent (pigment). It is more preferably 1 to 40 mass %. If the amount of the pigment dispersant is less than 1 mass %, the dispersibility of the coloring agent (pigment) may be inadequate, and accordingly a required ID (image density) may not be achieved and the fixing strength may be decreased. If the amount of the pigment dispersant is more than 100 mass %, the dispersant of an amount larger than the amount required for dispersion of the pigment is added, and accordingly an extra amount of the dispersant may be dissolved in the insulating liquid, which may adversely affect the chargeability and the fixing strength of the toner particles.

One kind of the pigment dispersant or a combination of two or more kinds thereof can be used.

<Insulating Liquid>

The first liquid developer and the second liquid developer each include an insulating liquid (carrier liquid). While the first and second liquid developers may include the same insulating liquids or different insulating liquids respectively, it is preferable that the first and second liquid developers include the same insulating liquids in terms of control of the viscosity. This insulating liquid may at least have an electrical resistance (on the order of $10^{11}$ to $10^{16}$ Ω·cm) to the extent that will not disturb an electrostatic latent image. It is also preferable that the insulating liquid is a solvent having low odor and low toxicity. Generally, examples of the insulating liquid may be aliphatic hydrocarbon, alicyclic hydrocarbon, aromatic hydrocarbon, halogenated hydrocarbon, polysiloxane, and the like. The insulating liquid, however, is not limited to them. In particular, in terms of odor, harmlessness, and cost, normal paraffin-based solvent and isoparaffin-based solvent are preferred. More specific examples thereof may be Moresco White (trademark, manufactured by Matsumura Oil Research Corporation), Isopar (trademark, manufactured by Exxon Mobil Chemical), Shellsol (trademark, manufactured by Shell Chemicals), IP solvent 1620, IP solvent 2028, IP solvent 2835 (they are each trademark, manufactured by Idemitsu Chemicals), and the like. One kind of the insulating liquid or a combination of two or more kinds of the insulating liquids can be used.

<Method of Manufacture>

Each of the first toner particles and the second toner particles in the present embodiment can be manufactured based on a conventionally known technique, for example, granulation method, pulverization method, or the like. Preferably, the first toner particles and the second toner particles are manufactured by the same method of manufacture so that control of various characteristics such as the viscosity of the liquid developer is easier.

The pulverization method herein refers to a method according to which a resin and a coloring agent such as pigment are melted and kneaded in advance and then pulverized. This pulverization can be performed in a dry condition or a wet condition in an insulating liquid.

The granulation method includes the following methods of manufacture classified by difference in the mechanism of forming toner particles, namely suspension polymerization method, emulsion polymerization method, particle coagulation method, a method that adds a poor solvent to a resin solution and precipitates the resin, spray drying, or the like, as well as a method according to which two different kinds of resins are used so that the resin in the toner particles has the core-shell structure.

While the method of manufacturing the first toner particles and the second toner particles is not particularly limited, preferably the granulation method is employed rather than the pulverization method. This is for the following reason. Regarding the pulverization method, the shape of the toner particles is likely to distort regardless of whether it is done in a dry condition or a wet condition, the particle size distribution is difficult to control, and the viscosity is accordingly difficult to control. In contrast, regarding the granulation method, the particles are relatively close to the spherical shape, the particle size distribution is sharp, and the viscosity can easily be controlled.

Among the granulation methods, a method of manufacture that produces the resin of the toner particles that has the core-shell structure is preferred for the following reason. Namely, this method produces toner particles having a structure in which the surface of the core resin is entirely or partially covered with the shell resin, and thus the hydrocarbon long chain may be included in the shell resin so that the hydrocarbon long chain having high affinity for the insulating liquid is present in the surface of the toner particles, to thereby enhance the effect of adjusting the viscosity. In this case, the hydrocarbon long chain may be introduced into the shell resin by the following means. Namely, a vinyl monomer having the hydrocarbon long chain in a side chain may be polymerized, or the hydrocarbon long chain may be introduced as a graft group if the monomer is not the vinyl monomer, for example.

In the following, the method of manufacturing the first toner particles and the second toner particles will be described in further detail. In a description common to the first toner particles and the second toner particles, the toner particles will simply be referred to as toner particles. Likewise, the first resin and the second resin will simply be referred to as resin, the first core resin and the second core resin will simply be referred to as core resin, and the first shell resin and the second shell resin will simply be referred to as shell resin, unless otherwise specified.

The liquid developer is obtained by dispersing, in an insulating liquid, toner particles manufactured in the following way. In the case where the toner particles are manufactured in the insulating liquid, this can directly be the liquid developer.

<Method of Manufacturing Toner Particles Having Core-Shell Structure>

Toner particles having the core-shell structure in the present embodiment refer to the toner particles described below. Specifically, in toner particles (C) dispersed in an insulating liquid (L), toner particles (C) has the core-shell structure in which shell particles (A) containing a shell resin (a) attach to or cover the surface of core particles (B) containing a core resin (b). The coloring agent and any other components can be contained in the shell resin (a) and/or the core resin (b) and are preferably contained suitably in the core resin (b).

In the following, a method of manufacturing toner particles having the core-shell structure will be described in detail. In the following description, core-shell type toner particles may be expressed as toner particles (C) and a liquid developer including toner particles (C) may be expressed as liquid developer (X) for the sake of convenience.

<Shell Resin (a)>

The shell resin (a) in the present embodiment may be a thermoplastic resin or a thermosetting resin. The shell resin (a) may for example be vinyl resin, polyester resin, polyurethane resin, epoxy resin, polyamide resin, polyimide resin, silicone resin, phenol resin, melamine resin, urea resin, aniline resin, ionomer resin, polycarbonate resin, and the like. As the shell resin (a), two or more kinds of the above-listed resins may be used in combination.

In terms of easiness to obtain the toner particles in the present embodiment, preferably at least one of vinyl resin, polyester resin, polyurethane resin, and epoxy resin is used as the shell resin (a), and more preferably vinyl resin is suitably used.

<Vinyl Resin>

The vinyl resin may be a homopolymer obtained through homopolymerization of monomers having a polymerizable double bond (homopolymer including bonded units derived from vinyl monomers), a copolymer obtained through copolymerization of two or more kinds of monomers having a polymerizable double bond (copolymer including bonded units derived from vinyl monomers), or a polymer of monomers having a polymerizable double bond and monomers (m) having a polymerizable double bond with a molecular chain (k). In particular, preferably it is a polymer of monomers having a polymerizable double bond and monomers (m) having a polymerizable double bond with a molecular chain (k). Examples of the monomer having a polymerizable double bond may be (1) to (9) described below. In the following monomers, a hydrocarbon group having a carbon number of 8 to 30, if included, is the hydrocarbon long chain.

(1) Hydrocarbon Having Polymerizable Double Bond

Hydrocarbon having a polymerizable double bond is preferably aliphatic hydrocarbon having a polymerizable double bond described under (1-1) below.

(1-1) Aliphatic Hydrocarbon Having Polymerizable Double Bond

Aliphatic hydrocarbon having a polymerizable double bond is preferably chain hydrocarbon having a polymerizable double bond described under (1-1-1) below, or cyclic hydrocarbon having a polymerizable double bond described under (1-1-2) below, for example.

(1-1-1) Chain Hydrocarbon Having Polymerizable Double Bond

Examples of chain hydrocarbon having a polymerizable double bond may be: alkene having a carbon number of 2 to 30 (for example, ethylene, propylene, butene, isobutylene, pentene, heptene, diisobutylene, octene, dodecene, octadecene, or the like); and alkadiene having a carbon number of 4 to 30 (for example, butadiene, isoprene, 1,4-pentadiene, 1,5-hexadiene, 1,7-octadiene, or the like).

(1-1-2) Cyclic Hydrocarbon Having Polymerizable Double Bond

Examples of cyclic hydrocarbon having a polymerizable double bond may be: mono or dicycloalkene having a carbon number of 6 to 30 (for example, cyclohexene, vinylcyclohexene, ethylidene bicycloheptene, or the like); mono or dicycloalkadiene having a carbon number of 5 to 30 (for example, monocyclopentadiene, dicyclopentadiene, or the like).

(2) Monomers Having Carboxyl Group and Polymerizable Double Bond and Salts of them Examples of a monomer having a carboxyl group and a polymerizable double bond may be: unsaturated monocarboxylic acid having a carbon number of 3 to 15 (for example, (meth)acrylic acid, crotonic acid, isocrotonic acid, cinnamic acid, or the like); unsaturated dicarboxylic acid (anhydride) having a carbon number of 3 to 30 (for example, maleic acid (anhydride), fumaric acid (anhydride), itaconic acid (anhydride), citraconic acid (anhydride), mesaconic acid (anhydride), or the like); monoalkyl (carbon number: 1 to 10) ester of unsaturated dicarboxylic acid having a carbon number of 3 to 10 (for example, maleic acid monomethylester, maleic acid monodecyl ester, fumaric acid monoethyl ester, itaconic acid monobutyl ester, citraconic acid monodecyl ester, or the like). The term "(meth)aclylic" herein means acrylic and/or methacrylic.

Examples of the salts of the monomers may be alkali metal salt (for example, sodium salt, potassium salt, or the like), alkaline earth metal salt (for example, calcium salt, magnesium salt, or the like), ammonium salt, amine salt, quaternary ammonium salt, and the like.

Amine salt is not particularly limited as long as it is an amine compound, and examples of amine salt may be: primary amine salt (for example, ethylamine salt, butylamine salt, octylamine salt, or the like); secondary amine salt (for example, diethylamine salt, dibutylamine salt, or the like); tertiary amine salt (for example, triethylamine salt, tributylamine salt, or the like).

Examples of quaternary ammonium salt may be tetraethyl ammonium salt, triethyllauryl ammonium salt, tetrabutyl ammonium salt, tributyllauryl ammonium salt, and the like.

Examples of salts of monomers having a carboxyl group and a polymerizable double bond may be sodium acrylate, sodium methacrylate, monosodium maleate, disodium maleate, potassium acrylate, potassium methacrylate, monopotassium maleate, lithium acrylate, cesium acrylate, ammonium acrylate, calcium acrylate, aluminum acrylate, and the like.

(3) Monomers Having Sulfo Group and Polymerizable Double Bond and Salts of them (4) Monomers Having Phosphono Group and Polymerizable Double Bond and Salts of them (5) Monomers Having Hydroxyl Group and Polymerizable Double Bond (6) Nitrogen-Containing Monomer Having Polymerizable Double Bond Examples of a nitrogen-containing monomer having a polymerizable double bond may be monomers described under (6-1) to (6-4) below.

(6-1) Monomer Having Amino Group and Polymerizable Double Bond

Examples of a monomer having an amino group and a polymerizable double bond may be aminoethyl (meth)acrylate, dimethyl aminoethyl (meth)acrylate, diethyl aminoethyl (meth)acrylate, t-butyl aminoethyl methacrylate, N-aminoethyl (meth)acrylamide, (meth)allyl amine, morpholinoethyl (meth)acrylate, 4-vinylpyridine, 2-vinylpyridine, crotylamine, N,N-dimethyl aminostylene, methyl-α-acetoaminoacrylate, vinylimidazole, N-vinylpyrrole, N-vinylthiopyrrolidone, N-aryl phenylenediamine, aminocarbazole, aminothiazole, aminoindole, aminopyrrole, aminoimidazole, aminomercaptothiazole, and the like. The term "(meth)acrylate" herein means acrylate and/or methacrylate, and the term "(meth)allyl" herein means allyl and/or methallyl.

The monomer having an amino group and a polymerizable double bond may be salts of monomers listed above. Examples of the salts of the monomers listed above may be salts listed as "the salts of the monomers" under "(2) Monomers having carboxyl group and polymerizable double bond and salts of them" described above.

(6-2) Monomer Having Amide Group and Polymerizable Double Bond

Examples of a monomer having an amide group and a polymerizable double bond may be (meth)acrylamide, N-methyl (meth)acrylamide, N-butyl acrylamide, diacetone acrylamide, N-methylol (meth)acrylamide, N,N'-methylenebis(meth)acrylamide, cinnamic acid amide, N,N-dimethyl acrylamide, N,N-dibenzyl acrylamide, methacryl formamide, N-methyl-N-vinyl acetamide, N-vinyl pyrrolidone, and the like.

(6-3) Monomer with a Carbon Number of 3-10 Having Nitrile Group and Polymerizable Double Bond Examples of a monomer with a carbon number of 3 to 10 having a nitrile group and a polymerizable double bond may be (meth)acrylonitrile, cyanostyrene, cyanoacrylate, and the like. The term "(meth)acrylo" herein means acrylo and/or methacrylo.

(6-4) Monomer with a Carbon Number of 8 to 12 Having Nitro Group and Polymerizable Double Bond Examples of a monomer with a carbon number of 8 to 12 having a nitro group and a polymerizable double bond may be nitrostyrene and the like.

(7) Monomer with a Carbon Number of 6 to 18 Having Epoxy Group and Polymerizable Double Bond (8) Monomer with a Carbon Number of 2 to 16 Having Halogen and Polymerizable Double Bond (9) Ester with a Carbon Number of 4 to 16 Having Polymerizable Double Bond Examples of an ester with a carbon number of 4 to 16 having a polymerizable double bond may be: vinyl acetate; vinyl propionate; vinyl butyrate; diallyl phthalate; diallyl adipate; isopropenyl acetate; vinyl methacrylate; methyl-4-vinyl benzoate; cyclohexyl methacrylate; benzyl methacrylate; phenyl (meth)acrylate; vinyl methoxyacetate; vinyl benzoate; ethyl-α-ethoxyacrylate; alkyl (meth)acrylate having an alkyl group with a carbon number of 1 to 11 (for example, methyl (meth)acrylate, ethyl (meth)acrylate, propyl (meth)acrylate, butyl (meth)acrylate, 2-ethylhexyl (meth)acrylate, and the like); dialkyl fumarate (two alkyl groups are straight-chain alkyl groups, branched alkyl groups, or alicyclic alkyl groups with a carbon number of 2 to 8); dialkyl maleate (two alkyl groups are straight-chain alkyl groups, branched alkyl groups, or alicyclic alkyl groups with a carbon number of 2 to 8); poly(meth)allyloxy alkanes (for example, diallyloxyethane, triallyloxyethane, tetraallyloxyethane, tetraallyloxypropane, tetraallyloxybutane, tetramethallyloxyethane, or the like); monomer having a polyalkylene glycol chain and a polymerizable double bond (for example, polyethylene glycol (Mn=300) mono (meth)acrylate, polypropylene glycol (Mn=500) monoacrylate, methyl alcohol ethylene oxide ("ethylene oxide" is hereinafter abbreviated as "EO") 10 mol adduct (meth) acrylate, lauryl alcohol EO 30 mol adduct (meth)acrylate, or the like); poly(meth)acrylates {for example, poly(meth) acrylate of polyhydric alcohol [for example, ethylene glycol di(meth)acrylate, propylene glycol di(meth)acrylate, neopentyl glycol di(meth)acrylate, trimethylolpropane tri(meth) acrylate, polyethylene glycol di(meth)acrylate, or the like]}. The term "(meth)allylo" herein means allylo and/or methallylo. Regarding the above, in the case where a hydrocarbon group with a carbon number of 8 to 30 is included, the hydrocarbon long chain is present in a side chain of the vinyl resin.

Specific examples of the vinyl resin may be styrene-(meth)acrylate copolymer, styrene-butadiene copolymer, (meth)acrylic acid-(meth)acrylate copolymer, styrene-acrylonitrile copolymer, styrene-maleic acid (anhydride) copolymer, styrene-(meth)acrylic acid copolymer, styrene-(meth) acrylic acid-divinyl benzene copolymer, styrene-styrene sulfonic acid-(meth)acrylate copolymer, and the like.

As set forth above, the vinyl resin may be a homopolymer or a copolymer of monomers having a polymerizable double bond described above in (1) to (9), or a polymer of monomers having a polymerizable double bond described above in (1) to (9) and monomers (m) having a polymerizable double bond with a molecular chain (k). The molecular chain (k) may be a straight-chain-like or branch-like hydrocarbon long chain having a carbon number of 8 to 30, or the like. Preferably a difference in the SP (solubility parameter) value between the molecular chain (k) in the monomer (m) and the insulating liquid (L) is 2 or less. "SP value" is herein a numerical value calculated in accordance with the Fedors method [Polym. Eng. Sci. 14(2) 152, (1974)].

While the monomer (m) having a polymerizable double bond with a molecular chain (k) is not particularly limited, examples of the monomer may be monomers (m1) to (m2) described below. As the monomer (m), two or more kinds of monomers (m1) to (m2) may be used in combination. In the case where the monomer (m1) or monomer (m2) is used, the hydrocarbon long chain is present in a side chain of the vinyl resin.

Monomer (m1) having straight-chain-like hydrocarbon long chain with a carbon number of 8 to 30 (preferably 16 to 25) and polymerizable double bond Examples of this monomer (m1) may be mono-straight-chain alkyl (alkyl's carbon number: 8 to 30) ester of unsaturated monocarboxylic acid, mono-straight-chain alkyl (alkyl's carbon number: 8 to 30) ester of unsaturated dicarboxylic acid, and the like. Examples of the aforementioned unsaturated monocarboxylic acid and unsaturated dicarboxylic acid may be carboxyl-group-containing vinyl monomers having a carbon number of 3 to 24 such as (meth) acrylic acid, maleic acid, fumaric acid, crotonic acid, itaconic acid, citraconic acid, and the like.

Specific examples of the monomer (m1) may be dodecyl (meth)acrylate, stearyl (meth)acrylate, behenyl (meth)acrylate, hexadecyl (meth)acrylate, heptadecyl (meth)acrylate, eicosyl (meth)acrylate, and the like.

Monomer (m2) having branch-like hydrocarbon long chain with a carbon number of 8 to 30 (preferably 16 to 25) and polymerizable double bond Examples of this monomer (m2) may be branched alkyl (alkyl's carbon number: 8 to 30) ester of unsaturated monocarboxylic acid, mono-branched alkyl (alkyl's carbon number: 8 to 30) ester of unsaturated dicarboxylic acid, and the like. Examples of the aforementioned unsaturated monocarboxylic acid and unsaturated dicarboxylic acid may be similar to those listed above as specific examples of the unsaturated monocarboxylic acid and unsaturated dicarboxylic acid of the monomer (m1).

Specific examples of the monomer (m2) may be 2-decyltetradecyl (meth)acrylate, and the like.

<Melting Point>

The shell resin (a) has a melting point of preferably 0 to 220° C., more preferably 30 to 200° C., and still more preferably 40 to 80° C. In terms of the particle size distribution and the shape of the toner particles, as well as the powder fluidity, the heat-resistant storage stability, and the stress resistance of the liquid developer (X), and the like, the melting point of the shell resin (a) is preferably equal to or higher than the temperature during manufacture of the liquid developer (X). If the melting point of the shell resin is lower than the temperature during manufacture of the liquid developer, it may be difficult to prevent the toner particles from being aggregated together and it may be difficult to prevent the toner particles from being split. Moreover, the distribution width of the distribution of toner particles is less prone to be narrower. In other words, there may be a large extent of variation between particle sizes of the toner particles.

The melting point herein is measured in accordance with the method defined under ASTM D3418-82 by means of a differential scanning calorimeter (such as "DSC20" or "SSC/580" manufactured by Seiko Instruments Inc.).

<Mn (Number Average Molecular Weight)>

Mn (obtained by measurement with GPC) of the shell resin (a) is preferably 100 to 5000000, more preferably 200 to 5000000, and still more preferably 500 to 500000.

<SP Value>

The shell resin (a) has an SP value of preferably 7 to 18 $(cal/cm^3)^{1/2}$, and more preferably 8 to 14 $(cal/cm^3)^{1/2}$.

<Shell Particles (A)>

The shell particles (A) in the present embodiment include the shell resin (a). As to the method of manufacturing the shell particles (A), any of known methods can be employed, without being particularly limited. Examples of the method may be the following methods [1] to [7].

[1]: A known dry pulverizer such as jet mill is used to pulverize the shell resin (a) in a dry condition.

[2]: Powder of the shell resin (a) is dispersed in an organic solvent and pulverized in the wet condition by means of a known wet dispersion machine such as bead mill, roll mill, or the like.

[3]: A solution of the shell resin (a) is sprayed and dried by means of a spray drier or the like.

[4]: To a solution of the shell resin (a), a poor solvent is added or the solution is cooled to cause supersaturation of the shell resin (a) and thereby precipitate the shell resin (a).

[5]: A solution of the shell resin (a) is dispersed in water or an organic solvent.

[6]: A precursor of the shell resin (a) is polymerized in water by means of emulsion polymerization method, soap-free emulsion polymerization method, seed polymerization method, suspension polymerization method, or the like.

[7]: A precursor of the shell resin (a) is polymerized in an organic solvent through dispersion polymerization or the like.

Among these methods, the methods [4], [6], and [7] are preferred and the methods [6] and [7] are more preferred in terms of the ease of manufacture of the shell particles (A).

<Volume Average Particle Size>

In this case, the volume average particle size (median size) of the shell particles (A) can be adjusted appropriately so that the particle size is appropriate for obtaining toner particles (C) of a desired particle size. The shell particles (A) have a volume average particle size of preferably 0.0005 to 3 μm. The upper limit of the volume average particle size of the shell particles (A) is more preferably 2 μm and still more preferably 1 μm. The lower limit of the volume average particle size of the shell particles (A) is more preferably 0.01 μm, still more preferably 0.02 μm, and most preferably 0.04 μm. In the case for example where toner particles (C) having a volume average particle size of 1 μm are to be obtained, the volume average particle size of the shell particles (A) is preferably 0.0005 to 0.3 μm and more preferably 0.001 to 0.2 μm. In the case for example where toner particles (C) having a volume average particle size of 10 μm are to be obtained, the volume average particle size of the shell particles (A) is preferably 0.005 to 3 μm and more preferably 0.05 to 2 μm.

<Core Resin (b) and Core Particles (B)>

Examples of the core resin (b) in the present embodiment may be vinyl resin, polyester resin, polyurethane resin, epoxy resin, polyamide resin, polyimide resin, silicone resin, phenol resin, melamine resin, urea resin, aniline resin, ionomer resin, polycarbonate resin, and the like. As the core resin (b), two or more kinds of the above-listed resins may be used in combination. Among the core resins, polyester resin is preferred.

Examples of the polyester resin may be a polycondensate of polyol and polycarboxylic acid, acid anhydride of polycarboxylic acid, or lower alkyl (alkyl group's carbon number: 1 to 4) ester of polycarboxylic acid, and the like. For polycondensation reaction, a known polycondensation catalyst or the like can be used.

The ratio between polyol and polycarboxylic acid is not particularly limited. The ratio between polyol and polycarboxylic acid may be set so that the equivalent ratio ([OH]/[COOH]) between the hydroxyl group [OH] and the carboxyl group [COOH] is preferably 2/1 to 1/5, more preferably 1.5/1 to 1/4, and still more preferably 1.3/1 to 1/3. Regarding the resins exemplified below, in the case where a hydrocarbon group having a carbon number of 8 to 30 is included, the resin includes a hydrocarbon long chain.

Examples of diol (10) may be: alkylene glycol having a carbon number of 2 to 30 (for example, ethylene glycol, 1,2-propylene glycol, 1,3-propylene glycol, 1,4-butanediol, 1,6-hexanediol, octanediol, decanediol, dodecanediol, tetradecanediol, neopentylglycol, 2,2-diethyl-1,3-propanediol, or the like); alkylene ether glycol having Mn=106 to 10000 (for example, diethylene glycol, triethylene glycol, dipropylene glycol, polyethylene glycol, polypropylene glycol, polytetramethylene ether glycol, or the like); alicyclic diol having a carbon number of 6 to 24 (for example, 1,4-cyclohexanedimethanol, hydrogenated bisphenol A, or the like); alkylene oxide (hereinafter "alkylene oxide" is abbreviated as "AO") adduct (the number of added moles: 2 to 100) of the aforementioned alicyclic diol having Mn=100 to 10000 (for example, 1,4-cyclohexanedimethanol EO 10-mole adduct or the like); AO [for example, EO, propylene oxide (hereinafter abbreviated as "PO") or butylene oxide] adduct (the number of added moles: 2 to 100) of bisphenols having a carbon number of 15 to 30 (for example, bisphenol A, bisphenol F, bisphenol S, or the like), or the aforementioned AO adduct of polyphenol having a carbon number from 12 to 24 (for example, catechol, hydroquinone, resorcin, or the like) (such as EO 2 to 4-mole adduct of bisphenol A or PO 2 to 4-mole adduct of bisphenol A); polylactonediol having a weight average molecular weight (hereinafter abbreviated as "Mw")=100 to 5000 (for example, poly-ε-caprolactonediol or the like); polybutadienediol having Mw=1000 to 20000, and the like.

Examples of polyol (11) may be: aliphatic polyhydric alcohol having a valence of 3 to 8 or more and having a carbon number of 3 to 10 (for example, glycerin, trimethylolethane, trimethylolpropane, pentaerythritol, sorbitan, sorbitol, or the like), AO (having a carbon number of 2 to 4) adduct (the number of added moles is 2 to 100) of trisphenol having a carbon number of 25 to 50 (for example, EO 2 to 4-mole adduct of trisphenol or PO 2 to 4-mole adduct of trisphenol polyamide); AO (having a carbon number of 2 to 4) adduct (the number of added moles is 2 to 100) of novolac resin (for example, phenol novolac, cresol novolac, or the like) having n=3 to 50 (for example, phenol novolac PO 2-mole adduct or phenol novolac EO 4-mole adduct); AO (having a carbon number of 2 to 4) adduct (the number of added moles is 2 to 100) of polyphenol having a carbon number of 6 to 30 (for example, pyrogallol, phloroglucinol, 1,2,4-benzenetriol, or the like) (for example, pyrogallol EO 4-mole adduct); acrylic polyol having n=20 to 2000 {for example, a copolymer of hydroxyethyl (meth)acrylate and a monomer having other polymeric double bond [for example, styrene, (meth)acrylic acid, (meth)acrylic acid ester], or the like}.

Among these, as polyol (11), aliphatic polyhydric alcohol and AO adduct of novolac resin are preferred, and AO adduct of novolac resin is more preferred.

Examples of dicarboxylic acid (12) may be: alkane dicarboxylic acid having a carbon number of 4 to 32 (for example, succinic acid, adipic acid, sebacic acid, azelaic acid, dodecane dicarboxylic acid, octadecane dicarboxylic acid, or the like); alkene dicarboxylic acid having a carbon number of 4 to 32 (for example, maleic acid, fumaric acid, citraconic acid, mesaconic acid, or the like); branched alkene dicarboxylic acid having a carbon number of 8 to 40 [for example, dimer acid, alkenyl succinic acid (for example, dodecenyl succinic acid, pentadecenyl succinic acid, or octadecenyl succinic acid), or the like]; branched alkane dicarboxylic acid having a carbon number of 12 to 40 [for example, alkyl succinic acid (for example, decyl succinate, dodecyl succinate, octadecyl succinate, or the like), or the like]; aromatic dicarboxylic acid having a carbon number of 8 to 20 (for example, phthalic acid, isophthalic acid, terephthalic acid, naphthalene dicarboxylic acid, or the like).

Further, the polyester resin with crystallinity enables a developer excellent in low-temperature fixity to be provided. Furthermore, urethane-modified polyester produced from polyester resin with a chain extended by isocyanate is excellent in low-temperature fixity, and moreover keeps elasticity at high temperature and has anti-offset quality.

In order to give crystallinity, monomers of acid and alcohol forming polyester may be aliphatic monomers.

<SP Value>

The SP value of the core resin (b) may be adjusted as appropriate. The core resin (b) has an SP value of preferably 8 to 16 $(cal/cm^3)^{1/2}$ and more preferably 9 to 14 $(cal/cm^3)^{1/2}$.

<Formation of Resin Having Core-Shell Structure>

The resin included in the toner particles in the present embodiment preferably has the core-shell structure in which the shell particles (A) containing the shell resin (a) attach to or cover the surface of the core particles (B) containing the core resin (b) as described above.

The mass ratio [(B):(A)] between the core particles (B) and the shell particles (A) is preferably 99:1 to 30:70. In terms of the uniformity of the particle size of the toner particles (C) and the heat-resistant stability of the liquid developer (X), the ratio [(B):(A)] is more preferably 98:2 to 50:50 and still more preferably 97:3 to 65:35. If the content by percentage (mass ratio) of the shell particles (A) is excessively low, the dispersibility of the toner particles may be deteriorated or a desired particle size may be difficult to obtain. If the content by percentage (mass ratio) of the shell particles (A) is excessively high, the fixity may be deteriorated.

The resin having this core-shell structure can for example be manufactured in the following way.

Specifically, a resin is dissolved in a good solvent to thereby produce a core resin solution. A poor solvent having a different SP value from the good solvent is mixed with the core resin solution together with a shell resin. The resultant solution is sheared to thereby form droplets. After this, the good solvent is volatilized. Accordingly, resin fine particles having the core-shell structure can be formed.

EXAMPLES

In the following, the present invention will be described in more detail with reference to Examples. The present invention, however, is not limited to them.

Manufacture Example 1

In the following way, a dispersion liquid (W1) of shell particles (A1) was manufactured.

First, in a reaction vessel provided with a stirring apparatus, a heating and cooling apparatus, a thermometer, a dropping funnel, a desolventizing apparatus, and a nitrogen introduction tube, 195 parts by mass of THF (tetrahydrofuran) was placed. Next, in a beaker made of glass, a liquid mixture made up of 100 parts by mass of 2-decyltetradecyl methacrylate, 30 parts by mass of methacrylic acid, 70 parts by mass of an equimolar reaction product of hydroxyethyl methacrylate and phenyl isocyanate, and 0.5 parts by mass of azobis methoxy dimethyl valeronitrile was placed, and stirred and mixed at 20° C. A monomer solution was thus prepared and placed in the dropping funnel. After substitution of the gas phase portion in the reaction vessel with nitrogen, the monomer solution was dropped at 70° C. for one hour in a sealed condition.

Subsequently, after three hours from the end of dropping, a mixture of 0.05 parts by mass of azobis methoxy dimethyl valeronitrile and 5 parts by mass of THF was added. After reaction at 70° C. for three hours, the temperature was lowered to room temperature. Thus, a solution of the copolymer which was to serve as the shell particles (A1) was obtained.

400 parts by mass of the solution of the copolymer which was to serve as the shell particles (A1) was dropped, while being stirred, into 600 parts by mass of an insulating liquid (trademark: "IP solvent 2028" manufactured by Idemitsu Kosan Co., Ltd.), and THF was distilled off at 40° C. in a reduced pressure condition of 0.039 MPa. Finally, IP solvent 2028 was added so that the concentration of the solid in the dispersion liquid was 25 mass %, and accordingly the dispersion liquid (W1) of the shell particles (A1) was obtained.

A laser-based particle size distribution meter (trademark: "LA-920" manufactured by Horiba, Ltd.) was used to measure the volume average particle size of the shell particles (A1) included in the dispersion liquid (W1). The measured size was 0.12 μm.

These shell particles (A1) included the aforementioned copolymer (vinyl resin) as the shell resin. The ratio (mass ratio) of the hydrocarbon long chain ("2-decyltetradecyl" portion in 2-decyltetradecyl methacrylate) to the shell resin was calculated from the original component ratio. The calculated ratio was 39.7 mass %.

Manufacture Example 2

In the following way, a dispersion liquid (W2) of shell particles (A2) was manufactured.

First, in a reaction vessel provided with a stirring apparatus, a heating and cooling apparatus, a thermometer, a dropping funnel, a desolventizing apparatus, and a nitrogen introduction tube, 195 parts by mass of THF was placed. Next, in a beaker made of glass, a liquid mixture made up of 120 parts by mass of 2-decyltetradecyl methacrylate, 30 parts by mass of methacrylic acid, 50 parts by mass of an equimolar reaction product of hydroxyethyl methacrylate and phenyl isocyanate, and 0.5 parts by mass of azobis methoxy dimethyl valeronitrile was placed, and stirred and mixed at 20° C. A monomer solution was thus prepared and placed in the dropping funnel. After substitution of the gas phase portion in the reaction vessel with nitrogen, the monomer solution was dropped at 70° C. for one hour in a sealed condition.

Subsequently, after three hours from the end of dropping, a mixture of 0.05 parts by mass of azobis methoxy dimethyl valeronitrile and 5 parts by mass of THF was added. After reaction at 70° C. for three hours, the temperature was lowered to room temperature. Thus, a solution of the copolymer which was to serve as the shell particles (A2) was obtained.

400 parts by mass of the solution of the copolymer which was to serve as the shell particles (A2) was dropped, while being stirred, into 600 parts by mass of an insulating liquid (trademark: "IP solvent 2028" manufactured by Idemitsu Kosan Co., Ltd.), and THF was distilled off at 40° C. in a reduced pressure condition of 0.039 MPa. Finally, IP solvent 2028 was added so that the concentration of the solid in the dispersion liquid was 25 mass %, and accordingly the dispersion liquid (W2) of the shell particles (A2) was obtained.

A laser-based particle size distribution meter (trademark: "LA-920" manufactured by Horiba, Ltd.) was used to measure the volume average particle size of the shell particles (A2) included in the dispersion liquid (W2). The measured size was 0.12 μm.

These shell particles (A2) included the aforementioned copolymer (vinyl resin) as the shell resin. The ratio (mass ratio) of the hydrocarbon long chain ("2-decyltetradecyl" portion in 2-decyltetradecyl methacrylate) to the shell resin was calculated from the original component ratio. The calculated ratio was 47.7 mass %.

Manufacture Example 3

In the following way, a dispersion liquid (W3) of shell particles (A3) was manufactured.

First, in a reaction vessel provided with a stirring apparatus, a heating and cooling apparatus, a thermometer, a dropping funnel, a desolventizing apparatus, and a nitrogen introduction tube, 195 parts by mass of THF was placed. Next, in a beaker made of glass, a liquid mixture made up of 100 parts by mass of 2-dodecyl methacrylate, 30 parts by mass of methacrylic acid, 70 parts by mass of an equimolar reaction product of hydroxyethyl methacrylate and phenyl isocyanate, and 0.5 parts by mass of azobis methoxy dimethyl valeronitrile was placed, and stirred and mixed at 20° C. A monomer solution was thus prepared and placed in the dropping funnel. After substitution of the gas phase portion in the reaction vessel with nitrogen, the monomer solution was dropped at 70° C. for one hour in a sealed condition.

Subsequently, after three hours from the end of dropping, a mixture of 0.05 parts by mass of azobis methoxy dimethyl valeronitrile and 5 parts by mass of THF was added. After reaction at 70° C. for three hours, the temperature was lowered to room temperature. Thus, a solution of the copolymer which was to serve as the shell particles (A3) was obtained.

400 parts by mass of the solution of the copolymer which was to serve as the shell particles (A3) was dropped, while being stirred, into 600 parts by mass of an insulating liquid (trademark: "IP solvent 2028" manufactured by Idemitsu Kosan Co., Ltd.), and THF was distilled off at 40° C. in a reduced pressure condition of 0.039 MPa. Finally, IP solvent 2028 was added so that the concentration of the solid in the dispersion liquid was 25 mass %, and accordingly the dispersion liquid (W3) of the shell particles (A3) was obtained.

A laser-based particle size distribution meter (trademark: "LA-920" manufactured by Horiba, Ltd.) was used to measure the volume average particle size of the shell particles (A3) included in the dispersion liquid (W3). The measured size was 0.14 μm.

These shell particles (A3) included the aforementioned copolymer (vinyl resin) as the shell resin. The ratio (mass ratio) of the hydrocarbon long chain ("2-dodecyl" portion in 2-dodecyl methacrylate) to the shell resin was calculated from the original component ratio. The calculated ratio was 33.2 mass %.

Manufacture Example 4

In the following way, a dispersion liquid (W4) of shell particles (A4) was manufactured.

First, in a reaction vessel provided with a stirring apparatus, a heating and cooling apparatus, a thermometer, a dropping funnel, a desolventizing apparatus, and a nitrogen introduction tube, 195 parts by mass of THF was placed. Next, in a beaker made of glass, a liquid mixture made up of 120 parts by mass of 2-dodecyl methacrylate, 30 parts by mass of methacrylic acid, 50 parts by mass of an equimolar reaction product of hydroxyethyl methacrylate and phenyl isocyanate, and 0.5 parts by mass of azobis methoxy dimethyl valeronitrile was placed, and stirred and mixed at 20° C. A monomer solution was thus prepared and placed in the dropping funnel. After substitution of the gas phase portion in the reaction vessel with nitrogen, the monomer solution was dropped at 70° C. for one hour in a sealed condition.

Subsequently, after three hours from the end of dropping, a mixture of 0.05 parts by mass of azobis methoxy dimethyl valeronitrile and 5 parts by mass of THF was added. After reaction at 70° C. for three hours, the temperature was lowered to room temperature. Thus, a solution of the copolymer which was to serve as the shell particles (A4) was obtained.

400 parts by mass of the solution of the copolymer which was to serve as the shell particles (A4) was dropped, while being stirred, into 600 parts by mass of an insulating liquid (trademark: "IP solvent 2028" manufactured by Idemitsu Kosan Co., Ltd.), and THE was distilled off at 40° C. in a reduced pressure condition of 0.039 MPa. Finally, IP solvent 2028 was added so that the concentration of the solid in the dispersion liquid was 25 mass %, and accordingly the dispersion liquid (W4) of the shell particles (A4) was obtained.

A laser-based particle size distribution meter (trademark: "LA-920" manufactured by Horiba, Ltd.) was used to measure the volume average particle size of the shell particles (A4) included in the dispersion liquid (W4). The measured size was 0.11 μm.

These shell particles (A4) included the aforementioned copolymer (vinyl resin) as the shell resin. The ratio (mass ratio) of the hydrocarbon long chain ("2-dodecyl" portion in 2-dodecyl methacrylate) to the shell resin was calculated from the original component ratio. The calculated ratio was 39.8 mass %.

Manufacture Example 5

In the following way, a solution (Y1) for forming a core resin (b1) was manufactured.

First, in a reaction vessel provided with a stirring apparatus, a heating and cooling apparatus, and a thermometer, 937 parts by mass of polyester resin I (Mn: 6000) obtained from sebacic acid, adipic acid, and ethylene glycol (molar ratio 0.8:0.2:1) and 300 parts by mass of acetone were placed and stirred so that dissolution was uniform, and a solution was thus obtained.

Next, in this solution, 92 parts by mass of isophorone diisocyanate (IPDI) was placed and reacted at 80° C. for six hours. When the NCO value reached zero, 28 parts by mass of terephthalic acid anhydride was placed and reacted at 180° C. for one hour. Accordingly, the core resin (b1) which was urethane-modified polyester resin was obtained.

800 parts by mass of the obtained core resin (b1) and 1200 parts by mass of acetone were placed and stirred in a beaker, so that the core resin (b1) was uniformly dissolved in acetone. Accordingly, the solution (Y1) for forming the core resin (b1) was obtained. The core resin (b1) had Mn of 22000 and the concentration of the urethane group was 1.38%. The concentration of the core resin (b1) in the solution (Y1) for forming the core resin (b1) was 40 mass %.

Manufacture Example 6

In the following way, a coloring agent dispersion liquid (P1) in which the coloring agent was a cyan pigment was manufactured.

First, in a beaker, 20 parts by mass of acid-treated copper phthalocyanine (trademark: "FASTOGEN Blue FDB-14" manufactured by DIC Corporation) which was a cyan pigment, 5 parts by mass of a pigment dispersant (trademark: "AJISPER PB-821" manufactured by Ajinomoto Fine-Techno Co., Inc.), and 75 parts by mass of acetone were placed and stirred so that uniform dispersion is achieved. After this, copper phthalocyanine was finely dispersed by a bead mill. Thus, the coloring agent dispersion liquid (P1)

was obtained. The coloring agent dispersion liquid (P1) had a volume average particle size of 0.17 μm.

Manufacture Example 7

In the following way, a coloring agent dispersion liquid (P2) in which the coloring agent was a magenta pigment was manufactured.

First, in a beaker, 20 parts by mass of carmine 6B (trademark: "SYMULER Brilliant Carmine 6B" manufactured by DIC Corporation) which was a magenta pigment, 5 parts by mass of a pigment dispersant (trademark: "AJISPER PB-821" manufactured by Ajinomoto Fine-Techno Co., Inc.), and 75 parts by mass of acetone were placed and stirred so that uniform dispersion is achieved. After this, carmine 6B was finely dispersed by a bead mill. Thus, the coloring agent dispersion liquid (P2) was obtained. The coloring agent dispersion liquid (P2) had a volume average particle size of 0.22 μm.

Manufacture Example 8

In the following way, a coloring agent dispersion liquid (P3) in which the coloring agent was a yellow pigment was manufactured.

First, in a beaker, 20 parts by mass of PY-815 (trademark: "Paliotol Yellow D1155" manufactured by BASF) which was a yellow pigment, 5 parts by mass of a pigment dispersant (trademark: "AJISPER PB-821" manufactured by Ajinomoto Fine-Techno Co., Inc.), and 75 parts by mass of acetone were placed and stirred so that uniform dispersion is achieved. After this, PY-815 was finely dispersed by a bead mill. Thus, the coloring agent dispersion liquid (P3) was obtained. The coloring agent dispersion liquid (P3) had a volume average particle size of 0.2 μm.

Manufacture Example 9

In the following way, a coloring agent dispersion liquid (P4) in which the coloring agent was a black pigment was manufactured.

First, in a beaker, 12 parts by mass of carbon black (trademark: "Mogul L" manufactured by Cabot Corporation) which was a black pigment, 8 parts by mass of acid-treated copper phthalocyanine (trademark: "FASTOGEN Blue FDB-14" manufactured by DIC Corporation), 5 parts by mass of a pigment dispersant (trademark: "AJISPER PB-821" manufactured by Ajinomoto Fine-Techno Co., Inc.), and 75 parts by mass of acetone were placed and stirred so that uniform dispersion is achieved. After this, carbon black and copper phthalocyanine were finely dispersed by a bead mill. Thus, the coloring agent dispersion liquid (P4) was obtained. The coloring agent dispersion liquid (P4) had a volume average particle size of 0.24 μm.

Manufacture Example 10

In the following way, a liquid developer (Bk-11) including toner particles manufactured by means of the granulation method was manufactured. The toner particles have the core-shell structure made up of a core resin and a shell resin.

First, in a beaker, 40 parts by mass of the solution (Y1) for forming the core resin (b1) and 54 parts by mass of the coloring agent dispersion liquid (P4) were placed and stirred at 25° C. with a mixer (trademark: "TK Auto Homo Mixer" manufactured by Tokushu Kika Kogyo Co., Ltd.) at 8000 rpm so that uniform dispersion is achieved. Thus, a resin solution (Y1P4) was obtained.

Next, in another beaker, 67 parts by mass of an insulating liquid (trademark: "IP solvent 2028" manufactured by Idemitsu Kosan Co., Ltd.) and 9 parts by mass of the dispersion liquid (W1) of the shell particles (A1) were placed, and uniform dispersion was achieved. Thus, a dispersion liquid was obtained.

Subsequently, while this dispersion liquid was stirred at 25° C. with the TK Auto Homo Mixer at 10000 rpm, the whole amount of the resin solution (Y1P4) was placed and they were stirred for two minutes. Following this, this liquid mixture was placed in a reaction vessel provided with a stirring apparatus, a heating and cooling apparatus, a thermometer, and a desolventizing apparatus, the temperature was raised to 35° C., and thereafter acetone was distilled off in a reduced pressure condition of 0.039 MPa at the same temperature until the acetone concentration became 0.5 wt % or less. Thus, the liquid developer (Bk-11) including toner particles having the core-shell structure made up of the core resin (containing the coloring agent) and the shell resin was obtained.

In this liquid developer (Bk-11), the toner particle concentration was 30 mass %, the pigment content by percentage in the toner particles was 34.0 mass %, the mass ratio (core resin):(shell resin) in the toner particles was 92.91:7.09, and the mass ratio (numerical value calculated from the original raw-material component ratio) of the hydrocarbon long chain ("2-decyltetradecyl" portion in 2-decyltetradecyl methacrylate which was a constituent unit of shell particles A1) to the toner particles was 2.81%. The mass ratio of the hydrocarbon long chain to the toner particles that was determined through direct analysis of this liquid developer by means of a GC/MS apparatus (trademark: "GCMS-QP2010" manufactured by Shimadzu Corporation) to which connected a pyrolysis-gas chromatography/mass spectrometer (P-GC/MS) (trademark: "PY-2020iD" manufactured by Frontier Laboratories Ltd.) was also 2.81%.

Manufacture Examples 11 to 18

Liquid developers including toner particles in which the resin had the core-shell structure were manufactured similarly to Manufacture Example 10 except that the formulations indicated in the following Table 1 were used.

TABLE 1

| Manufacture Example No. | name of liquid developer | amount of used solution Y1 | coloring agent dispersion liquid type | coloring agent dispersion liquid amount used | dispersion liquid of shell particles type | dispersion liquid of shell particles amount used | amount of used insulating liquid | toner particle concentration | pigment content by percentage | shell ratio (%) | hydrocarbon long chain |
|---|---|---|---|---|---|---|---|---|---|---|---|
| 10 | Bk-11 | 40 parts by mass | P4 | 54 parts by mass | W1 | 9 parts by mass | 67 parts by mass | 30 mass % | 34.0 mass % | 7.09 | 2.81% |
| 11 | Bk-12 | 36 parts by mass | P4 | 54 parts by mass | W1 | 15 parts by mass | 62 parts by mass | 30 mass % | 34.1 mass % | 11.85 | 4.70% |
| 12 | Bk-21 | 40 parts by mass | P4 | 54 parts by mass | W2 | 9 parts by mass | 67 parts by mass | 30 mass % | 34.0 mass % | 7.09 | 3.37% |

TABLE 1-continued

| Manufacture Example No. | name of liquid developer | amount of used solution Y1 | coloring agent dispersion liquid type | amount used | dispersion liquid of shell particles type | amount used | amount of used insulating liquid | toner particle concentration | pigment content by percentage | shell ratio (%) | hydrocarbon long chain |
|---|---|---|---|---|---|---|---|---|---|---|---|
| 13 | Bk-31 | 40 parts by mass | P4 | 54 parts by mass | W3 | 9 parts by mass | 67 parts by mass | 30 mass % | 34.0 mass % | 7.09 | 2.35% |
| 14 | Bk-41 | 38 parts by mass | P4 | 54 parts by mass | W4 | 12 parts by mass | 65 parts by mass | 30 mass % | 34.1 mass % | 9.46 | 3.77% |
| 15 | C-11 | 55 parts by mass | P1 | 30 parts by mass | W1 | 9 parts by mass | 67 parts by mass | 30 mass % | 18.9 mass % | 7.09 | 2.81% |
| 16 | C-31 | 55 parts by mass | P1 | 30 parts by mass | W3 | 9 parts by mass | 67 parts by mass | 30 mass % | 18.9 mass % | 7.09 | 2.35% |
| 17 | M-11 | 53 parts by mass | P2 | 33 parts by mass | W1 | 9.5 parts by mass | 67 parts by mass | 30 mass % | 20.7 mass % | 7.46 | 2.96% |
| 18 | Y-11 | 46 parts by mass | P3 | 44 parts by mass | W1 | 9 parts by mass | 67 parts by mass | 30 mass % | 27.8 mass % | 7.11 | 2.82% |

Table 1 shows that the liquid developer (Bk-12) of Manufacture Example 11 for example was obtained similarly to Manufacture Example 10 in all respects except that, in contrast to the formulation for Manufacture Example 10, 36 parts by mass of the solution (Y1) for forming the core resin (b1) identical to that of Manufacture Example 10 was used, 54 parts by mass of the coloring agent dispersion liquid (P4) also identical to that of Manufacture Example 10 was used, 62 parts by mass of the insulating liquid (IP solvent 2028) identical to that of Manufacture Example 10 was used, and 15 parts by mass of the dispersion liquid (W1) of the shell particles (A1) identical to that of Manufacture Example 10 was used.

It is also shown that the liquid developer (Bk-12) of Manufacture Example 11 had a toner particle concentration of 30 mass % (see "toner particle concentration" in Table 1), a pigment content by percentage in the toner particles of 34.1 mass % (see "pigment content by percentage" in Table 1), a mass ratio (core resin):(shell resin) in the toner particles of 88.15:11.85 (see "shell ratio" in Table 1, this ratio in Table 1 is expressed as the ratio "11.85%" of the shell resin), and a mass ratio of the hydrocarbon long chain to the toner particles of 4.70% (this numerical value is indicated in the column "hydrocarbon long chain" in Table 1).

Manufacture Example 19

In the following way, a liquid developer (C-3) including toner particles manufactured by means of the pulverization method was manufactured.

First, in a flask provided with a stirring machine, a thermometer, a cooling tube, and a dropping funnel, 290 parts by mass of an insulating liquid (trademark: "IP solvent 2028" manufactured by Idemitsu Kosan Co., Ltd.) was placed, heated, and stirred. Meanwhile, a monomer solution made up of 40 parts by mass of dodecyl methacrylate, 20 parts by mass of methacrylic acid, 40 parts by mass of methyl methacrylate, and 1 part by mass of benzoyl peroxide was dropped for two hours. With the temperature maintained, polymerization was performed for five hours. Thus, a resin dispersion liquid (Y2) in which a resin (b2) which was a vinyl resin was dispersed was produced.

Subsequently, to this resin dispersion liquid (Y2), 23 parts by mass of copper phthalocyanine (trademark: "FASTOGEN Blue GNPT" manufactured by DIC Corporation) which was a coloring agent was further added and dispersed with a sand mill for 24 hours. Accordingly the liquid developer (C-3) including toner particles manufactured by means of the pulverization method was obtained.

In this liquid developer (C-3), the toner particle concentration was 30 mass %, the pigment content by percentage in the toner particles was 18.5%, and the mass ratio (numerical value calculated from the original raw-material component ratio) of the hydrocarbon long chain ("dodecyl" portion in dodecyl methacrylate) to the toner particles was 21.5%. The mass ratio of the hydrocarbon long chain to the toner particles that was determined through direct analysis of this liquid developer by means of a GC/MS apparatus (trademark: "GCMS-QP2010" manufactured by Shimadzu Corporation) to which connected a pyrolysis-gas chromatography/mass spectrometer (P-GC/MS) (trademark: "PY-2020iD" manufactured by Frontier Laboratories Ltd.) was also 21.5%.

Manufacture Example 20

In the following way, a liquid developer (Bk-3) including toner particles manufactured by means of the pulverization method was manufactured.

First, in a flask provided with a stirring machine, a thermometer, a cooling tube, and a dropping funnel, 350 parts by mass of an insulating liquid (trademark: "IP solvent 2028" manufactured by Idemitsu Kosan Co., Ltd.) was placed, heated, and stirred. Meanwhile, a monomer solution made up of 40 parts by mass of dodecyl methacrylate, 20 parts by mass of methacrylic acid, 20 parts by mass of methyl methacrylate, and 1 part by mass of benzoyl peroxide was dropped for two hours. With the temperature maintained, polymerization was performed for five hours. Thus, a resin dispersion liquid (Y3) in which a resin (b3) which was a vinyl resin was dispersed was produced.

Subsequently, to this resin dispersion liquid (Y3), 30 parts by mass of carbon black (trademark: "Mogul L" manufactured by Cabot Corporation) and 20 parts by mass of copper phthalocyanine (trademark: "FASTOGEN Blue GNPT" manufactured by DIC Corporation) which were coloring agents were further added and dispersed with a sand mill for 24 hours. Accordingly the liquid developer (Bk-3) including toner particles manufactured by means of the pulverization method was obtained.

In this liquid developer (Bk-3), the toner particle concentration was 30 mass %, the pigment content by percentage in the toner particles was 33.1 mass %, and the mass ratio (numerical value calculated from the original raw-material component ratio) of the hydrocarbon long chain ("dodecyl"

portion in dodecyl methacrylate) to the toner particles was 17.6%. The mass ratio of the hydrocarbon long chain to the toner particles that was determined through direct analysis of this liquid developer by means of a GC/MS apparatus (trademark: "GCMS-QP2010" manufactured by Shimadzu Corporation) to which connected a pyrolysis-gas chromatography/mass spectrometer (P-GC/MS) (trademark: "PY-2020iD" manufactured by Frontier Laboratories Ltd.) was also 17.6%.

Manufacture Example 21

In the following way, a liquid developer (Bk-4) including toner particles manufactured by means of the pulverization method was manufactured.

First, in a flask provided with a stirring machine, a thermometer, a cooling tube, and a dropping funnel, 350 parts by mass of an insulating liquid (trademark: "IP solvent 2028" manufactured by Idemitsu Kosan Co., Ltd.) was placed, heated, and stirred. Meanwhile, a monomer solution made up of 60 parts by mass of dodecyl methacrylate, 20 parts by mass of methacrylic acid, 20 parts by mass of methyl methacrylate, and 1 part by mass of benzoyl peroxide was dropped for two hours. With the temperature maintained, polymerization was performed for five hours. Thus, a resin dispersion liquid (Y4) in which a resin (b4) which was a vinyl resin was dispersed was produced.

Subsequently, to this resin dispersion liquid (Y4), 30 parts by mass of carbon black (trademark: "Mogul L" manufactured by Cabot Corporation) and 20 parts by mass of copper phthalocyanine (trademark: "FASTOGEN Blue GNPT" manufactured by DIC Corporation) which were coloring agents were further added and dispersed with a sand mill for 24 hours. Accordingly the liquid developer (Bk-4) including toner particles manufactured by means of the pulverization method was obtained.

In this liquid developer (Bk-4), the toner particle concentration was 30 mass %, the pigment content by percentage in the toner particles was 33.1 mass %, and the mass ratio (numerical value calculated from the original raw-material component ratio) of the hydrocarbon long chain ("dodecyl" portion in dodecyl methacrylate) to the toner particles was 26.4%. The mass ratio of the hydrocarbon long chain to the toner particles that was determined through direct analysis of this liquid developer by means of a GC/MS apparatus (trademark: "GCMS-QP2010" manufactured by Shimadzu Corporation) to which connected a pyrolysis-gas chromatography/mass spectrometer (P-GC/MS) (trademark: "PY-2020iD" manufactured by Frontier Laboratories Ltd.) was also 26.4%.

Examples 1-8 and Comparative Examples 1-5

Liquid developer sets made up of respective combinations shown in Table 2 were prepared.

TABLE 2

| | first liquid developer | | | | second liquid developer | | | | |
|---|---|---|---|---|---|---|---|---|---|
| | name | average particle size | mass ratio of hydrocarbon long chain | viscosity | name | average particle size | mass ratio of hydrocarbon long chain | viscosity | viscosity ratio |
| Example 1 | Bk-12 | 1.25 μm | 4.70% | 36 | C-11 | 1.98 μm | 2.81% | 21 | B |
| Example 2 | Bk-21 | 2.09 μm | 3.37% | 28 | C-11 | 1.98 μm | 2.81% | 21 | A |
| Example 3 | Bk-21 | 2.09 μm | 3.37% | 28 | M-11 | 2.34 μm | 2.96% | 23 | A |
| Example 4 | Bk-21 | 2.09 μm | 3.37% | 28 | Y-11 | 2.51 μm | 2.82% | 24 | A |
| Example 5 | Bk-41 | 1.92 μm | 3.77% | 36 | C-31 | 2.15 μm | 2.35% | 25 | A |
| Example 6 | Bk-21 | 2.09 μm | 3.37% | 28 | C-31 | 2.15 μm | 2.35% | 25 | A |
| Example 7 | Bk-41 | 1.92 μm | 3.77% | 36 | C-11 | 1.98 μm | 2.81% | 21 | B |
| Example 8 | Bk-4 | 2.55 μm | 26.4% | 65 | C-3 | 2.17 μm | 21.5% | 30 | B |
| Comparative Example 1 | Bk-11 | 2.13 μm | 2.81% | 69 | C-11 | 1.98 μm | 2.81% | 21 | D |
| Comparative Example 2 | Bk-11 | 2.13 μm | 2.81% | 69 | M-11 | 2.34 μm | 2.96% | 23 | D |
| Comparative Example 3 | Bk-11 | 2.13 μm | 2.81% | 69 | Y-11 | 2.51 μm | 2.82% | 24 | D |
| Comparative Example 4 | Bk-31 | 2.33 μm | 2.35% | 78 | C-31 | 2.15 μm | 2.35% | 25 | D |
| Comparative Example 5 | Bk-3 | 2.11 μm | 17.6% | 97 | C-3 | 2.17 μm | 21.5% | 30 | D |

In Table 2, "name" for the first liquid developer and the second liquid developer is any name of the liquid developers manufactured respectively in Manufacture Examples 10 to 21. Namely, in the liquid developer set of Example 1, a combination of the liquid developer (Bk-12) in Manufacture Example 11 as the first liquid developer and the liquid developer (C-11) in Manufacture Example 15 as the second liquid developer is used.

<Measurement of Average Particle Size>

For each of the first liquid developers and the second liquid developers used in the Examples and Comparative Examples, the average particle size of the toner particles was measured with a particle size distribution meter (trademark: "FPIA-3000S" manufactured by Sysmex Corporation). As a flow solvent, IP2028 identical to the insulating liquid was used. Specifically, 50 mg of each sample was placed in 20 g of IP2028 to which 30 mg of a dispersant (trademark: "S13940" manufactured by Lubrizol Japan Limited) was added, and its suspension was subjected to dispersion treatment with an ultrasonic dispersion machine (trademark: "Ultrasonic Cleaner Model VS-150" manufactured by VELVO-CLEAR). After this, the average particle size of the volume distribution (median size ($D_{50}$) of the volume distribution) of each sample was measured. The results are shown under "average particle size" in Table 2.

<Measurement of Viscosity and Evaluation of Viscosity Ratio>

The viscosity of each of the first liquid developers and the second liquid developers used in the Examples and Comparative Examples was measured with a viscometer (trademark: "Viscomate viscometer VM-10A-L" manufactured by CBC Co. Ltd.). Specifically, each liquid developer stirred in an environment of 25° C. was put in a vessel and the viscosity after one minute was measured. The results are indicated under "viscosity" (unit: mPa·s) in Table 2.

From the numerical values of the measured viscosity, the viscosity ratio (viscosity of the first liquid developer/viscosity of the second liquid developer) was determined and evaluated as follows. The results are indicated under "viscosity ratio" in Table 2. For the liquid developer set, the viscosity ratio indicated by "A" is the most suitable viscosity ratio and the viscosity ratios indicated by "B" to "D" are inferior in this order. The liquid developer sets evaluated with "A" to "C" are practically usable.

"A": 0.67≤viscosity ratio≤1.5

"B": 0.5≤viscosity ratio<0.67 or 1.5<viscosity ratio≤2

"C": 0.4≤viscosity ratio<0.5 or 2<viscosity ratio≤2.5

"D": 0<viscosity ratio<0.4 or 2.5<viscosity ratio

<Formation of Image>

The liquid developer set of each of the Examples and Comparative Examples was placed in an image forming apparatus 100 in FIG. 1 and an image was formed. Here, the image was formed by means of the image forming apparatus in which liquid developers of two colors were superimposed on each other in the stage of secondary transfer to a sheet of paper (recording medium) after primary transfer from a photoconductor to an intermediate transfer body. The liquid developers of the Examples, however, produce similar effects even in a system in which a plurality of liquid developers are superimposed on each other in the stage of direct transfer from the photoconductor to a sheet of paper, or a multicolor image forming apparatus in which a plurality of liquid developers are superimposed on each other on the photoconductor or the intermediate transfer body to thereby form a color image.

Developer tanks 5 are charged with the liquid developer set of each of the Examples and Comparative Examples (in FIG. 1, left developer tank 5 is charged with the first liquid developer and right developer tank 5 is charged with the second liquid developer). Each liquid developer is drawn up by an anilox roller 22 and transported to a leveling roller 21. Excess developer on the surface of anilox roller 22 is scraped by an anilox restriction blade 23 before reaching leveling roller 21, and leveling roller 21 adjusts the liquid developer so that the liquid developer has a uniform layer thickness. The liquid developer is conveyed from leveling roller 21 to a developer carrier 24.

A photoconductor 1 is charged by a charging unit 14 and a latent image is formed by an exposure unit 15. In accordance with the latent image as formed, the liquid developer in which the toner particles are given charge by a development charger 26 is developed on photoconductor 1. The liquid developer failed to be conveyed to photoconductor 1 is scraped by a cleaning blade 25 located downstream of the development unit and collected.

The liquid developer developed on photoconductor 1 undergoes primary electrostatic transfer at a primary transfer portion 13 to an intermediate transfer unit 16. The liquid developer carried on intermediate transfer body 16 undergoes secondary electrostatic transfer at a secondary transfer portion 11 to a recording medium 12. The liquid developer transferred to recording medium 12 (paper) is fixed by a fixing apparatus (not shown) and accordingly a printout image is completed.

The liquid developer which is not transferred and remains on photoconductor 1 and intermediate transfer unit 16 is scraped by cleaning blades 121, 191, and photoconductor 1 is repeatedly subjected to charging, exposure, and development steps for performing printing operation.

The toner particles are positively charged by development charger 26. The potential of intermediate transfer body 16 is −400 V and the potential of transfer roller 111 is −1200 V. The speed of transportation is set to 400 mm/s.

As recording medium 12, OK Top Coat 84 g/m$^2$ manufactured by Oji Paper Co., Ltd. was used. The amount of toner particles on secondary transfer unit 11 is 1.1 g/m$^2$. The specifications of the parts and the set conditions for the first liquid developer and those for the second liquid developer in FIG. 1 are identical to each other.

Images were thus formed. Consequently, the liquid developer set of each Example in which the viscosity ratio (viscosity of the first liquid developer/viscosity of the second liquid developer) was suitable could form a desired image. In contrast, the liquid developer set of each Comparative Example could not form a desired image, due to decrease of the black density while images are output through continuous drive.

It has accordingly been confirmed that the mass ratio of the hydrocarbon long chain to the first toner particles in the first liquid developer is made higher than the mass ratio of the hydrocarbon long chain to the second toner particles in the second liquid developer to reduce the difference between the viscosity of the first liquid developer and the viscosity of the second liquid developer, and thereby enable a more suitable image to be formed by the image forming apparatus.

Namely, the liquid developer sets in the present Examples have the above-described features and accordingly have excellent effects. Specifically, the difference in viscosity between the liquid developer containing carbon black and the liquid developer failing to contain carbon black is reduced to thereby cause no inconvenience even when such a set of a plurality of liquid developers is used in the image forming apparatus.

While the description of the embodiments and examples of the present invention has been given above, it has originally been intended to appropriately combine features of the above embodiments and examples.

Although the present invention has been described and illustrated in detail, it is clearly understood that the same is by way of illustration and example only and is not to be taken by way of limitation, the scope of the present invention being interpreted by the terms of the appended claims.

What is claimed is:

1. A liquid developer set comprising: a first liquid developer including an insulating liquid and first toner particles; and a second liquid developer including an insulating liquid and second toner particles, said first toner particles including carbon black and a first resin, said second toner particles including a coloring agent other than carbon black and a second resin, without including carbon black, said first resin and said second resin each including a hydrocarbon long chain which is a hydrocarbon group having a carbon number of 8 to 30, and a mass ratio of said hydrocarbon long chain to said first toner particles being higher than a mass ratio of said hydrocarbon long chain to said second toner particles, wherein said first toner particles have a core-shell structure, wherein said first resin comprises-a first core resin and a first shell resin, said first core resin includes said carbon black, said first shell resin includes said hydrocarbon long chain, a ratio C1:S1 falls within a range of 99:1 to 30:70 where C1 is a mass of said first core resin and S1 is a mass of said first shell resin, said second toner particles have a core-shell structure, wherein said second resin comprises a second core resin and a second shell resin, said second core resin includes said coloring agent other than carbon black, said second shell resin includes said hydrocarbon long chain, and a ratio C2:S2 falls within a range of 99:1 to 30:70 where C2 is a mass of said second core resin and S2 is a mass of said second shell resin.

2. The liquid developer set according to claim 1, wherein said first resin and said second resin each include a vinyl resin, and said hydrocarbon long chain is present in a side chain of said vinyl resin.

3. The liquid developer set according to claim 1, wherein a mass ratio of said hydrocarbon long chain to said first shell resin is higher than a mass ratio of said hydrocarbon long chain to said second shell resin.

4. The liquid developer set according to claim 1, wherein said liquid developer set comprises at least two second liquid developers that comprise different coloring agents from each other.

5. The liquid developer set according to claim 1, wherein the ratio C1:S1 falls within a range of 97:3 to 65:35.

6. The liquid developer set according to claim 5, wherein the ratio C2:S2 falls within a range of 97:3 to 65:35.

7. The liquid developer set according to claim 1, wherein the ratio C2:S2 falls within a range of 97:3 to 65:35.

8. The liquid developer set according to claim 1, wherein a mass ratio of said hydrocarbon long chain to said first shell resin is from 1.02 to 5 times larger than a mass ratio of the hydrocarbon long chain to the second shell resin.

9. The liquid developer set according to claim 1, wherein said first toner particles have an average particle size of from 0.5 μm to 5 μm and wherein said second toner particles have an average particle size of from 0.5 μm to 5 μm.

10. The liquid developer set according to claim 1, wherein said first toner particles comprise from 5% to 40% by mass of carbon black.

11. The liquid developer set according to claim 1, wherein said first toner particles comprise at least one coloring agent, wherein said at least one coloring agent includes said carbon black, wherein said first toner particles comprise a total content of coloring agent of from 5% to 50% by mass.

12. The liquid developer set according to claim 1, wherein said second toner particles comprise at least one coloring agent, wherein said at least one coloring agent excludes carbon black, wherein said second toner particles comprise a total content of coloring agent of from 5% to 50% by mass.

13. The liquid developer set according to claim 1, wherein a mass ratio of said hydrocarbon long chain to said first shell resin is from 1.02 to 5 times larger than a mass ratio of the hydrocarbon long chain to the second shell resin.

14. A liquid developer set comprising: a first liquid developer including an insulating liquid and first toner particles; and a second liquid developer including an insulating liquid and second toner particles, said first toner particles including carbon black and a first resin, said second toner particles including a coloring agent other than carbon black and a second resin, without including carbon black, said first resin and said second resin each including a hydrocarbon long chain which is a hydrocarbon group having a carbon number of 8 to 30, and a mass ratio of said hydrocarbon long chain to said first toner particles being higher than a mass ratio of said hydrocarbon long chain to said second toner particles, wherein said liquid developer set comprises at least two second liquid developers that comprise different coloring agents from each other.

15. A liquid developer set comprising: a first liquid developer including an insulating liquid and first toner particles; and a second liquid developer including an insulating liquid and second toner particles, said first toner particles including carbon black and a first resin, said second toner particles including a coloring agent other than carbon black and a second resin, without including carbon black, said first resin and said second resin each including a hydrocarbon long chain which is a hydrocarbon group having a carbon number of 8 to 30, and a mass ratio of said hydrocarbon long chain to said first toner particles being higher than a mass ratio of said hydrocarbon long chain to said second toner particles, wherein:

said first toner particles have a core-shell structure, wherein said first resin comprises a first core resin and a first shell resin, said first core resin includes said carbon black, said first shell resin includes said hydrocarbon long chain, said second toner particles have a core-shell structure, wherein said second resin comprises a second core resin and a second shell resin, said second core resin includes said coloring agent other than carbon black, said second shell resin includes said hydrocarbon long chain, a mass ratio of said hydrocarbon long chain to said first shell resin is from 1.02 to 5 times larger than a mass ratio of the hydrocarbon long chain to the second shell resin.

* * * * *